US005437950A

United States Patent [19]

Yu et al.

[11] Patent Number: 5,437,950

[45] Date of Patent: Aug. 1, 1995

[54] ELECTROPHOTOGRAPHIC IMAGIMG MEMBER WITH ENHANCED PHOTO-ELECTRIC SENSITIVITY

[75] Inventors: Robert C. U. Yu, Webster, N.Y.; Beng S. Ong, Mississauga, Canada

[73] Assignee: Xerox Corporation, Stamford, Conn.

[21] Appl. No.: 223,336

[22] Filed: Apr. 5, 1994

[51] Int. Cl.[6] ..... G03G 5/09; G03G 5/047

[52] U.S. Cl. ..... 430/58; 430/59; 430/83

[58] Field of Search ..... 430/58, 59, 83

[56] References Cited

U.S. PATENT DOCUMENTS

| | | | |
|---|---|---|---|
| 4,587,189 | 5/1986 | Hor et al. | 430/59 |
| 4,725,518 | 2/1988 | Carmichael et al. | 430/58 |
| 4,786,570 | 11/1988 | Yu et al. | 430/58 |
| 4,806,443 | 2/1989 | Yanus et al. | 430/56 |
| 4,835,081 | 5/1989 | Ong et al. | 430/59 |
| 4,877,702 | 10/1989 | Miyamoto et al. | 430/72 |
| 4,925,760 | 5/1990 | Baranyi et al. | 430/59 |
| 5,019,473 | 5/1991 | Nguyen et al. | 430/58 |
| 5,153,085 | 10/1992 | Akasaki et al. | 430/59 X |
| 5,288,584 | 2/1994 | Yu | 430/128 |

OTHER PUBLICATIONS

T. Saito T. Kawanishi and A. Kakuta, Photocarrier Generation Process of Phthalocyanine Particles Dispersed in a Polymer: Effects of Pigment Particle Size, Polymer Matrix and Addition of Fine y-Alumina Particles, Japanese Journal of Applied Physics, vol. 30, No. 7A, pp. I1182–I1185 Jul. 1991.

*Primary Examiner*—Roland Martin

[57] ABSTRACT

An electrophotographic imaging member including a substrate, an optional blocking layer, an optional thermoplastic adhesive interface layer, a thin charge generation layer comprising pigment particles dispersed in a film forming polymer binder having dissolved or molecularly dispersed therein an electron accepting/transporting compound, and a charge transport layer.

10 Claims, 4 Drawing Sheets

ELECTROPHOTOGRAPHIC IMAGIMG MEMBER WITH ENHANCED PHOTO-ELECTRIC SENSITIVITY

BACKGROUND INFORMATION

The present invention relates to an imaging system comprising an improved electrophotographic imaging member which exhibits enhanced photo-electrical sensitivity upon exposure to activating radiation.

Typical electrophotographic imaging members include photosensitive members or photoreceptors commonly utilized in electrophotographic or xerographic processes in either a flexible belt or rigid drum configuration. The flexible belt may be seamless or seamed.

These electrophotographic imaging members comprise a photoconductive layer comprising a single layer or composite layers. One type of composite photoconductive layer used in xerography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer. Generally, where the two electrically operative layers are supported on a conductive layer with the photoconductive layer capable of photogenerating holes and injecting photogenerated holes sandwiched between the contiguous charge transport layer and the supporting conductive layer, the outer surface of the charge transport layer is normally charged with a uniform charge of a negative polarity and the supporting electrode is utilized as an anode. Obviously, the supporting electrode may still function as an anode when the charge transport layer is sandwiched between the supporting electrode and a photoconductive layer which is capable of photogenerating electrons and injecting the photogenerated electrons into the charge transport layer. The charge transport layer in this latter embodiment must be capable of supporting the injection of photogenerated electrons from the photoconductive layer and transporting the electrons through the charge transport layer.

However, in a positively charged photosensitive member, the supporting electrode may also function as a cathode and the charge transport layer is sandwiched between the contiguous photoconductive layer and the supporting electrode. The photoconductive layer is capable of photogenerating holes and injecting the photogenerated holes into the charge transport layer which is then capable of supporting and transporting the injected holes across the entire thickness of the charge transport layer to reach the supporting electrode.

Various combinations of materials from charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more diamine compounds. Various generating layers comprising photoconductive layers exhibiting the capability of photogeneration of holes and injection of the holes into a charge transport layer are well known in the art. The charge generation layer may be homogeneous photoconductive material or a dispersion of photoconductive particles dispersed in a film forming binder as disclosed, for example, in U.S. Pat. No. 4,265,990, the disclosure thereof being incorporated herein in its entirety. Photosensitive members having at least two electrically operative layers, as disclosed above, provide excellent electrostatic latent images when charged with a uniform negative electrostatic charge, exposed to a light image and thereafter developed with finely divided electroscopic marking particles. The resulting toner image is usually transferred to a suitable receiving member such as paper.

As more advanced, higher speed electrophotographic copiers, duplicators and printers were developed, degradation of image quality was encountered during extended cycling. Moreover, complex, highly sophisticated duplicating and printing systems operating at very high speeds have placed stringent requirements including narrow operating limits on photoreceptors. For example, the numerous layers found in many modern photoconductive imaging members must be highly flexible, adhere well to adjacent layers, and exhibit predictable electrical characteristics within narrow operating limits to provide excellent toner images over many thousands of cycles. One typical type of multilayered imaging member that has been employed as a belt in electrophotographic imaging systems is a photoreceptor comprising a supporting substrate, a conductive layer, a hole blocking layer, an adhesive layer, a charge generating layer, a charge transport layer, and a conductive ground strip layer adjacent to one edge of the imaging layers. This imaging member may also comprise additional layers, such as an anti-curl back coating layer to the back of the supporting substrate opposite to the side of the active electrophotographic layers, to render the desirable imaging member flatness. An optional overcoating layer may also be used to protect the exposed charge transport layer from wear.

During machine operation, a photoconductive imaging member is constantly subjected to repetitive electrophotographic cycling conditions which subject the electrically operative layers to extensive electrical charging/discharging cycles, multiple exposures to light for latent imaging development and erasure, and heat due to temperature elevation resulting from machine operation. These repetitive electrical and light cycles fatigue the imaging member and lead to a gradual deterioration in the electrical characteristics of the imaging member and limit its service life in the field. In the attempt to fabricate a robust photoconductive imaging system, many innovative ideas have been attempted to overcome these shortfalls and to extend the electrical functional life of the imaging member.

One of the more encouraging advances in electrophotographic imaging member development that has emerged in recent years is the successful fabrication of a novel photoreceptor design which exhibits a nearly ideal capacitive charging characteristic, good photosensitivity, low electrical potential dark decay, and long term electrical cyclic stability. This novel photoreceptor design employed in belt form comprises a substrate, a conductive layer, a solution coated hole blocking layer, a solution coated adhesive layer, a thin vacuum sublimation deposited charge generation layer comprising pure organic pigment of benzimidazole perylene, a solution coated charge transport layer with an adjacent solution co-ground strip at one edge of the imaging layers, a solution anti-curl layer, and an optional overcoating layer.

Although this novel multi-layered photoreceptor device provides excellent electrical properties and extended life, it exhibits a major charge generation layer mud-cracking problem. The observed charge generating layer mud-cracks consists of a two-dimensional network of cracks. Mud-cracking is believed to be the result of built-in internal stress due to the vacuum sublimation deposition process and solvent penetration through the thin charge generation layer which dissolves the underlying adhesive layer during application of the charge transport layer solution. Cracking in the charge generation layer has a serious impact on the versatility of a photoreceptor and reduces its practical value. Charge generation layer mud-cracks not only can print out as defects, but may also act as stress concentration centers which propagate the cracks into the other electrically operative layer, i.e. the charge transport layer, during dynamic imaging member belt machine cycling.

While the above-mentioned imaging member gives the desirable electrical characteristic, there is an urgent need to resolve the cracking issue in order to render the imaging member design acceptable for long term cycling systems. Subsequently formulated innovative concepts directed to elimination of the problem have resulted in varying degrees of success. The most promising approach involves employing a solution dispersion coating technique, by means of which benzimidazole perylene particles are dispersed in a solution consisting of a binder polymer dissolved in a common organic solvent and the pigment dispersion such that after solution coating and drying at elevated temperatures, a crack-free binder generation layer comprising homogeneously dispersed benzimidazole perylene pigment in a polymeric matrix is obtained. The resulting photoreceptor device retains most of its excellent photo-electrical characteristics, but exhibits the major shortfall of having lower photosensitivity than a photoreceptor counterpart fabricated using sublimation deposited benzimidazole perylene charge generation layer. Since low photosensitivity photoreceptor requires a higher power exposure light source to carry out the xerographic imaging process, it increases the manufacturing cost of the machine, exacerbates the reflection interference fringes problem, and causes a reduction in image resolution which substantially and adversely affect the quality of print-out copies.

INFORMATION DISCLOSURE STATEMENT

U.S. Pat. No. 4,587,189 to Hor et al., issued May 6, 1986—Discloses an improved layered photoresponsive imaging member comprised of a supporting substrate; a vacuum evaporated photogenerator layer comprised of a perylene pigment selected from the group consisting of a mixture of bisbenzimidazo(2,1-a-1′,2′-b)anthra(2,1,9-def:6,5,10-d′e′f′)diisoquinoline-6,11-diona, and bisbenzimidazo(2,1,a:2′,1′-a)anthra(2,1,9-def:6,5,10-d′e′f′)diisoquinoline-10,21-dione, and N,N′-diphenyl-3,4,9,10-perylenebis(dicarboximide); and an aryl amine hole transport layer. If desired, the perylene pigment may be dispersed in a resinous binder.

U.S. Pat. No. 5,288,584 to Yu, issued Feb. 22, 1994—Discloses a process for fabricating flexible electrophotographic imaging members including providing a flexible substrate including a biaxially oriented thermoplastic polymer web coated with at least one thermoplastic adhesive layer, vapor depositing on the adhesive layer a thin charge generating layer, cooling the charge generating layer to induce strain in the charge generating layer as well as at the interface between the charge generating layer and the substrate, heating the flexible substrate to shrink the biaxially oriented thermoplastic polymer web and substantially remove the strain from the charge generating layer, and forming a layer of a charge transport coating solution on the charge generating layer, the charge transporting coating solution including a charge transporting film forming polymer matrix, and solvent for the film forming polymer matrix, and drying the charge transport coating solution.

U.S. Pat. No. 4,786,570 to Yu, issued Nov. 22, 1988—Discloses a flexible electrophotographic imaging members comprising a flexible substrate having an electrically conductive surface, a hole blocking layer,, an adhesive layer consisting essentially of a specified copolyester resin, a charge generation layer having a film forming component, and a diamine hole transport layer. Numerous types of photogenerating layers are disclosed including those containing benzimidazole perylene.

U.S. Pat. No. 4,877,702 to Miyamoto et al., issued Oct. 31, 1989—Discloses an electrophotographic sensitive layer which is provided with a single-layer type sensitive layer containing a specific perylene compound as an electric charge generating substance, a specific diamine derivative having a specified formula as the electric charge transferring substance and a binding resin.

U.S. Pat. No. 5,019,473 to Nguyen et al., issued May 28, 1991—An electrophotographic recording element is disclosed comprising a photoconductive perylene pigment, as a charge generation material, that is sufficiently finely and uniformly dispersed in a polymeric binder to provide the element with excellent electrophotographic speed. The perylene pigments are perylene-3,4,9,10-tetracarboxylic acid imide derivatives.

U.S. Pat. No. 4,925,760 to Baranyi et al., issued May 15, 1990—A layered photoresponsive imaging member is disclosed comprising a supporting substrate, a vacuum evaporated photogenerator layer comprised of certain pyranthrone pigments including tribromo-8,16-pyranthrenedione and trichloro-8,16-pyranthrenedione and an arylamine hole transport layer comprised of certain arylamine molecules dispersed in a resinous binder.

U.S. Pat. No. 4,835,081 to Ong et al., issued May 30, 1989—Discloses the fabrication of organic photoresponsive imaging members employing a positive surface charging approach. The photoresponsive imaging members comprise a substrate support, a conductive ground plane, a charge transport layer, a photogenerator layer, and a thin layer of protective overcoating of an electron transport polymer.

U.S. Pat. No. 4,806,443 to Yanus et al., issued Feb. 21, 1989—An electrostatographic imaging member and an electrophotographic imaging process for using the imaging member are disclosed in which the imaging member comprises a substrate and an electroconductive layer, the imaging member comprising a specific polymeric arylamine compound. The imaging member may comprise a substrate, charge generation layer and a charge transport layer. Numerous types of photogenerating layers are disclosed including those containing benzimidazole perylene.

U.S. Pat. No. 4,725,518 to Carmichael et al., issued Feb. 16, 1988—A process for preparing electrophotographic imaging members is disclosed comprising providing a photogenerating layer on a supporting substrate and applying a charge transport layer forming mixture to the photogenerating layer, the charge transport layer forming mixture comprising certain specified charge transporting aromatic amine compounds, a polymeric film forming resin, solvent and from about 1 part per million to about 10,000 parts per million, based on the weight of the aromatic amine, of a protonic acid or a Lewis acid.

T. Saito, T. Kawanishi, and A. Kakuta, Photocarrier Generation Process of Phthalocyanine Particles Dispersed in a Polymer: Effects of Pigment Particle Size, Polymer Matrix and Addition of Fine -Alumina Particles, Japanese Journal of Applied Physics, Vol. 30, No. 7A, p. L1182–L1185, July, 1991—Photocarrier generation is described to occur at the surface of the pigment particles. Therefore is reported that the generation efficiency (in a pigment particles dispersion charge generation layer) depends on the particle size of the pigment, the concentration of the pigment, the presence or absence of an electron acceptor in the material matrix of the charge generating layer, and the type of polymer used In copending U.S. application Ser. No. 07/545,831 (D/88308) filed on Jun. 29, 1990, in the name of Robert Yu, a process is described for avoiding mud crack formation of a vapor deposited charge generation layer by utilizing an adhesive layer that is not soluble in the solvent employed to deposit the charge transport layer. The entire disclosure of this application is incorporated herein by reference.

In copending U.S. application Ser. No. 930,631 (D/91644) filed on Aug. 17, 1992, in the name of Robert Yu, an approach is disclosed for improving the adhesion bond strength for a multi-layered electrophotographic imaging member at the contacting interphase region between a dispersion solution coated benzimidazole perylene charge generation layer and the adhesive interface layer, through a cross-linking process to form an interpenetration boundary network. The entire disclosure of this application is incorporated herein by reference.

SUMMARY OF THE INVENTION

It is, therefore, an object of the present invention to provide an improved electrophotographic imaging member which overcomes the above-noted deficiencies.

It is another object of the present invention to provide an improved electrophotographic imaging member which is free of charge generation layer cracking.

It is still another object of the present invention to provide an improved electrophotographic imaging member which exhibits greater photo-electrical sensitivity.

It is yet another object of the present invention to provide an improved electrophotographic imaging member which enhances image sharpness and copy print-out quality.

It is again another object of the present invention to provide an improved electrophotographic imaging member which minimizes reflection interference fringes formation.

It is another object of the present invention to provide an improved electrophotographic imaging member which provides excellent electrical properties and good adhesion bond strength between the internal coating layers.

It is yet another object of the present invention to provide an improved electrophotographic imaging member which gives extended photo-electrical service life.

It is also an object of the present invention to provide an improved electrophotographic imaging member which overcomes the problems of the prior art.

The foregoing objects and others are accomplished in accordance with this invention by providing an electrophotographic imaging member comprising a substrate, an optional blocking layer, an optional thermoplastic adhesive interface layer, a thin charge generation layer comprising pigment particles dispersed in a film forming polymer binder having dissolved or molecularly dispersed therein an electron accepting/transporting compound, and a charge transport layer.

BRIEF DESCRIPTION OF THE DRAWINGS

A more complete understanding of the imaging device of the present invention purpose can be obtained by reference to the accompanying drawings wherein.

These figures are merely schematic representations and are not intended to indicate relative size and dimensions of actual electrophotographic imaging members or components thereof.

DETAILED DESCRIPTION OF THE DRAWINGS

For the sake of convenience, the invention will be described for electrophotographic imaging members in flexible belt form only even though this invention also includes electrophotographic imaging members having a rigid drum configuration.

Figure 1A:
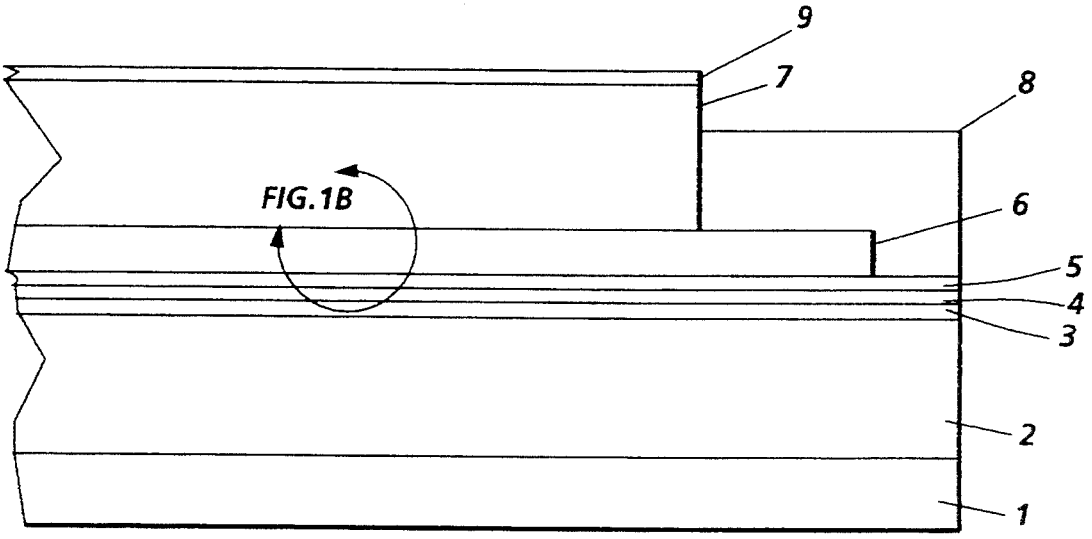
PRIOR ART FIG. 1A
FIG. 1A is a cross-sectional view of the configuration of a prior art electrophotographic imaging member utilizing a dispersion solution coated charge generation layer.

A representative structure of a prior art electrophotographic imaging member is shown in FIG. 1A. This imaging member is provided with an anti-curl back coating 1, a supporting substrate 2, an electrically conductive ground plane 3, a hole blocking layer 4, an adhesive layer 5, a charge generation layer 6 comprising pigment particles 10 dispersed in a polymer binder matrix, a charge transport layer 7, and a ground strip 8 adjacent charge transport layer 7 at an outer edge of the imaging member. An optional overcoating layer 9 is also shown in FIG. 1A.

The thickness of the support substrate layer 2 depends on numerous factors, including mechanical strength and economical considerations, and thus, this layer for a flexible belt may, for example, have a thickness of at least about 50 micrometers, or of maximum thickness less than about 150 micrometers, provided there are no adverse effects on the final electrophotographic imaging device. For drum type imaging member applications, the substrate is normally a rigid cylinder of metal, plastic or composites of metal and plastic. The conductive layer 3 may vary in thickness over substantially wide ranges depending on the optical transparency and flexibility desired for the electrophotographic imaging member. Accordingly, when a flexible electrophotographic imaging belt is desired, the thickness of the conductive layer may be between about 20 angstrom units and about 750 angstrom units, and more preferably between about 50 Angstrom units and about 200 angstrom units for an optimum combination of electrical conductivity, flexibility and light transmission. The conductive 30 layer may be an electrically conductive metal layer which may be formed, for example, on the substrate by any suitable coating technique, such as a vacuum depositing or sputtering technique. Typical metals include aluminum, zirconium, niobium, tantalum, vanadium, hafnium, titanium, nickel, stainless steel, chromium, tungsten, molybdenum, and the like. Where the entire substrate is an electrically conductive metal, the outer surface thereof can perform the function of an electrically conductive layer and a separate electrical conductive layer may be omitted.

After formation of an electrically conductive surface 3, a hole blocking layer 4 may be applied thereto. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may comprise, for example, nitrogen containing siloxanes or nitrogen containing titanium compounds as disclosed, for example, in U.S. Pat. Nos. 4,291,110, 4,338,387, 4,286,033 and 4,291,110. The disclosures of these patents are incorporated herein in their entirety. The blocking layer may be applied by any suitable conventional technique such as spraying, dip coating, draw bar coating, gravure coating, silk screening, air knife coating, reverse roll coating, vacuum deposition, chemical treatment and the like. The blocking layer should be continuous and preferably has a thickness of less than about 0.2 micrometer.

An optional adhesive layer 5 may be applied to the hole blocking layer. Any suitable adhesive layer may be utilized. One well known adhesive layer comprises a polyester resin (available as duPont 49,000, a linear saturated copolyester reaction product of four diacids and ethylene glycol, from E. I. duPont de Nemours & Co.). The du Pont 49,000 linear saturated copolyester consists of alternating monomer units of ethylene glycol and four randomly sequenced diacids in tile above indicated ratio and has a weight average molecular weight of about 70,000 and a Tg of about 32° C. If desired, the adhesive layer may comprise a copolyester resin such as, for example, Vitel PE-100, Vitel PE-200, Vitel PE-200D, and Vitel PE-222, all available from Goodyear Tire and Rubber Co. Any adhesive layer employed should be continuous and, preferably, have a dry thickness between about 200 micrometers and about 900 micrometers and, more preferably, between about 400 micrometers and about 700 micrometers. Any suitable solvent or solvent mixtures may be employed to form a coating solution of the polyester. Typical solvents include, for example, tetrahydrofuran, toluene, methylene chloride, cyclohexanone, and the like, and mixtures thereof. Any other suitable and conventional technique may be utilized to mix and thereafter apply the adhesive layer coating mixture of this invention to the charge blocking layer. Typical application techniques include spraying, dip coating, roll coating, wire wound rod coating, and the like. Drying of the deposited coating may be effected by any suitable conventional technique such as oven drying, infra red radiation drying, air drying and the like.

Any suitable charge generation layer 6 may be applied to the blocking layer 4 or adhesive layer 5, if one is employed, which can thereafter be overcoated with a contiguous charge transport layer 7. Examples of charge generation layer materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigment such as the X-form of metal free phthalocyanine described in U.S. Pat. No. 3,357,989, metal phthalocyanines such as vanadyl phthalocyanine and copper phthalocyanine, quinacridones available from E. I. duPont de Nemours & Co. under the tradename Monastral Red, Monastral violet and Monastral Red Y, Vat Orange 1 and Vat Orange 3 trade names for dibromo anthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example in U.S. Pat. No. 4,587,189, the entire disclosure thereof being incorporated herein by reference. Multi-photogenerating layer compositions may be utilized where a photoconductive layer enhances or reduces the properties of the photogenerating layer. Examples of this type of configuration are described in U.S. Pat. No. 4,415,639, the entire disclosure of thereof being incorporated herein by reference. Other suitable photogenerating materials known in the art may also be utilized, if desired. Any suitable charge generation binder layer comprising photoconductive pigment particles 10 dispersed in a film forming binder may be utilized. Photoconductive particles for charge generating binder layer such vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infrared light. The photogenerating materials selected should be sensitive to activating radiation having a wavelength between about about 400 and about 900 nm during the imagewise radiation exposure step in a electrophotographic imaging process to form an electrostatic latent image.

Figure 1B:
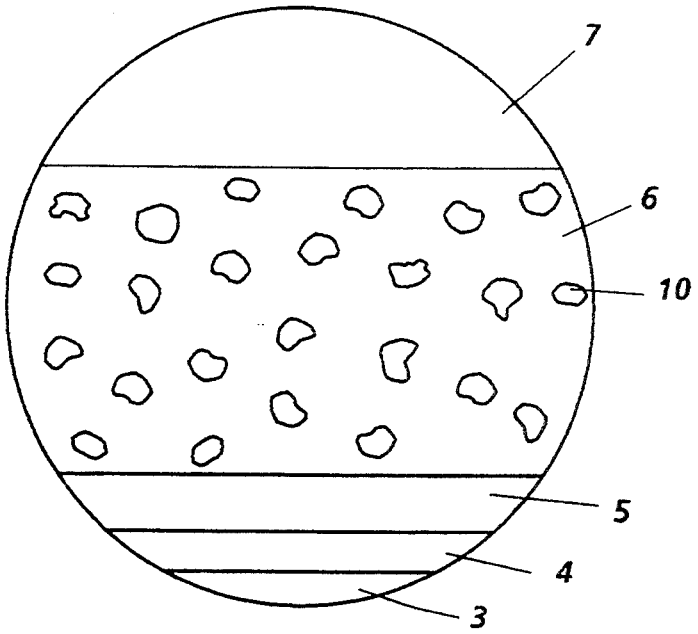
FIG. 1B shows an expanded cross-sectional view of a portion of the prior art electrophotographic imaging member of FIG. 1A focused at the charge generation layer.

Any suitable inactive resin materials may be employed in the photogenerating binder layer including those described, for example, in U.S. Pat. No. 3,121,006, the entire disclosure thereof being incorporated herein by reference. Typical organic resinous binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, and the like. These polymers may be block, random or alternating copolymers. A typical charge generation layer 6 comprising pigment particles 10 dispersed in a polymer binder is illustrated in FIG. 1B.

The photogenerating composition or pigment 10 can be present in the resinous binder composition in various amounts. Generally, from about 5 percent by volume to about 90 percent by volume of the photogenerating pigment 10 is dispersed in about 10 percent by volume to about 95 percent by volume of the resinous binder, and preferably from about 20 percent by volume to about 30 percent by volume of the photogenerating pigment 10 is dispersed in about 70 percent by volume to about 80 percent by volume of the resinous binder composition.

The thin charge generation layer 6 containing photoconductive compositions and/or pigments 10 and the resinous binder material generally ranges in thickness of from about 0.1 micrometer to about 5 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

The active charge transport layer 7 may comprise any suitable transparent organic polymer or non-polymeric material capable of supporting the injection of photogenerated holes and electrons from the trigonal selenium binder layer and allowing the transport of these holes or electrons through the organic layer to selectively discharge the surface charge. The active charge transport layer 7 not only serves to transport holes or electrons, but also protects the photoconductive layer 6 from abrasion or chemical attack and therefor extends the operating life of the photoreceptor imaging member. The charge transport layer 7 should exhibit negligible, if any, discharge when exposed to a wavelength of light useful in xerography, e.g. 400 nm (4000 angstroms) to 900 nm (9000 angstroms). Therefore, the charge transport layer 7 is substantially transparent to radiation in a region in which the photoconductor is to be used. Thus, the active charge transport layer 7 is a substantially non-photoconductive material which supports the injection of photogenerated holes from the charge generation layer 7. The active charge transport layer 7 is normally transparent when exposure is effected through the active layer to ensure that most of the incident radiation is utilized by the underlying charge carrier generator layer 6 for efficient photogeneration. The charge transport layer 7 in conjunction with the charge generation layer 6 in the instant invention is a material which is an insulator to the extent that an electrostatic charge placed on the charge transport layer 7 is not conducted in the absence of illumination.

The active charge transport layer 7 may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

The charge transport layer 7 forming mixture preferably comprises an aromatic amine compound. An especially preferred charge transport layer employed in one of the two electrically operative layers in the multilayer photoconductor of this invention comprises from about 35 percent to about 45 percent by weight of at least one charge transporting aromatic amine compound, and about 65 percent to about 55 percent by weight of a polymeric film forming resin in which the aromatic amine is soluble. The substituents should be free form electron withdrawing groups such as $NO_2$ groups, CN groups, and the like. Typical aromatic amine compounds include, for example, triphenylmethane, bis(4-diethylamine-2-methylphenyl)phenylmethane; 4′-4″-bis(diethylamino)-2′,2″-dimethyltriphenylmethane, N,N′-bis(alkylphenyl)-[1,1′-biphenyl]-4,4′-diamine wherein the alkyl is, for example, methyl, ethyl, propyl, n-butyl, etc., N,N′-diphenyl-N,N′-bis(-chlorophenyl)-[1,1′-biphenyl]-4,4′-diamine, N,N′-diphenyl-N,N′-bis(3″-methylphenyl)-(1,1′-biphenyl)-4,4′-diamine, and the like dispersed in an inactive resin binder.

Any suitable inactive resin binder soluble in methylene chloride, chlorobenzene or other suitable solvent may be employed in the process of solution preparation. Typical inactive resin binders include polycarbonate resin, polyvinylcarbazole, polyester, polyarylate, polyacrylate, polyether, polysulfone, and the like. Molecular weights can vary from about 20,000 to about 1,500,000.

Examples of photosensitive members having at least two electrically operative layers, including a charge generator layer and diamine containing transport layer, are disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507. The disclosures of these patents are incorporated herein in their entirety.

Any suitable and conventional techniques may be utilized to mix and thereafter apply the charge transport layer coating 7 mixture to the charge generating layer 6. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers and about 100 micrometers, but thicknesses outside this range can also be used.

The charge transport layer 7 should be an insulator to the extent that the electrostatic charge placed on the charge transport layer 7 is not conducted in the absence of illumination at a rate sufficient to prevent formation and retention of an electrostatic latent image thereon. In general, the ratio of the thickness of the charge transport layer 7 to the charge generator layer 6 is preferably maintained from about 2:1 to 200:1 and in some instances as great as 400:1.

Other layers such as conventional ground strip layer 8 comprising, for example, conductive particles dispersed in a film forming binder may be applied to one edge of the photoreceptor in contact with the conductive layer 3, hole blocking layer 4, adhesive layer 5 or charge generation layer 6.

A conventional ground strip 41 may be utilized along one edge of the electrophotographic imaging member. The ground strip 8 may comprise a film forming polymer binder and electrically conductive particles. The ground strip 8 may comprise materials that include those enumerated in U.S. Pat. No. 4,664,995. The ground strip layer 8 may have a thickness from about 7 micrometers to about 42 micrometers, and preferably from about 14 micrometers to about 23 micrometers.

Optionally, an overcoat layer 9 may also be utilized to improve resistance to abrasion. In some flexible electrophotographic imaging members, an anti-curl back coating 1 may be applied to the backside of the substrate opposite the side bearing the electrically active coating layers in order to provide flatness and/or abrasion resistance. These overcoating and anti-curl back coating layers may comprise organic polymers or inorganic polymers that are electrically insulating or slightly semi-conductive. For electrophotographic imaging members using rigid drum substrates, an anti-curl coating is not employed.

Figure 2A:
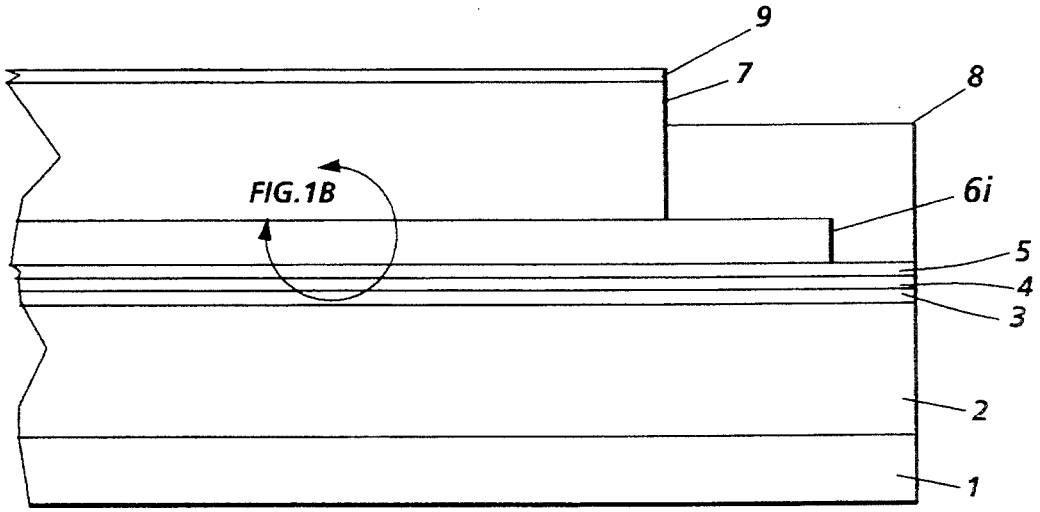
FIG. 2A is a cross-sectional view of one embodiment of an electrophotographic imaging member of this invention.

Referring to FIG. 2A, the structure of an electrophotographic imaging member of one embodiment of this invention is shown. This imaging member is provided with an anti-curl layer 1, a supporting substrate 2, an electrically conductive ground plane 3, a material modified charge generating layer 6i, a charge transport layer 7, a ground strip layer 8, and an optional overcoating layer 9. All of these coating layers are conventional like those described in FIG. 1A, but with the exception that the charge generation layer 6 in FIG. 1A has been modified to incorporate an electron accepting/transporting compound into a film forming binder matrix for photosensitivity enhancement thereby forming charge generating layer *6i*.

Figure 2B:
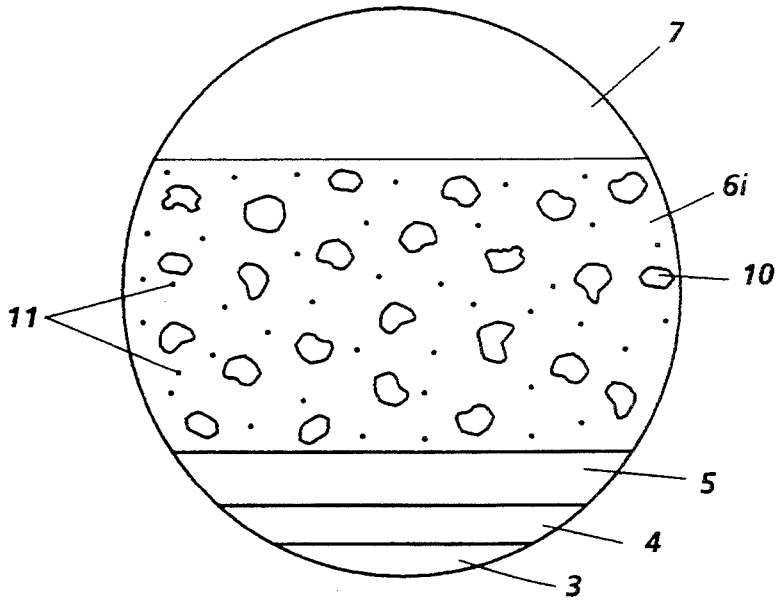
FIG. 2B shows an expanded cross-sectional view of a portion of the electrophotographic imaging member of this invention shown in FIG. 1B focused at a material modified charge generation layer.

In FIG. 2B, an expanded cross-sectional view of a portion of the electrophotographic imaging member embodiment of FIG. 2A, focusing around the charge generation layer *6i*, is pictorially represented. The charge generation layer *6i* comprises pigment particles 10 dispersed in a polymer binder matrix having dissolved therein an electron accepting/transporting compound 11 to enhance the efficiency of photocarriers generation at the pigment particles surface and to expedite the electron mobility to reach the underlying conductive ground plane 3 during xerographic imaging process. Although the electron accepting/transporting compound 11 is dissolved or otherwise homogeneously dispersed at a molecular level in the polymer matrix of the charge generating layer rather than as discrete particles, a dot representation is employed in FIG. 2B to depict electron accepting/transporting compound 11 for the purpose of illustration only.

The electrophotographic imaging member of the present invention may be employed in any suitable and conventional electrophotographic imaging process which utilizes uniform charging prior to imagewise exposure to activating electromagnetic radiation. Thus, the imaging surface of an electrophotographic member is uniformly charged with an electrostatic charge and imagewise exposed to activating electromagnetic radiation. Conventional positive or reversal development techniques may be employed to form a marking material image on the imaging surface of the electrophotographic imaging member of this invention. Thus, by applying a suitable electrical bias and selecting toner having the appropriate polarity of electrical charge, one may form a toner image in the charged areas or discharged areas on the imaging surface of the electrophotographic member of the present invention. For example, for positive development, charged toner particles are attracted to the oppositely charged electrostatic areas of the imaging surface and for reversal development, charged toner particles are attracted to the discharged areas of the imaging surface.

Figure 3:
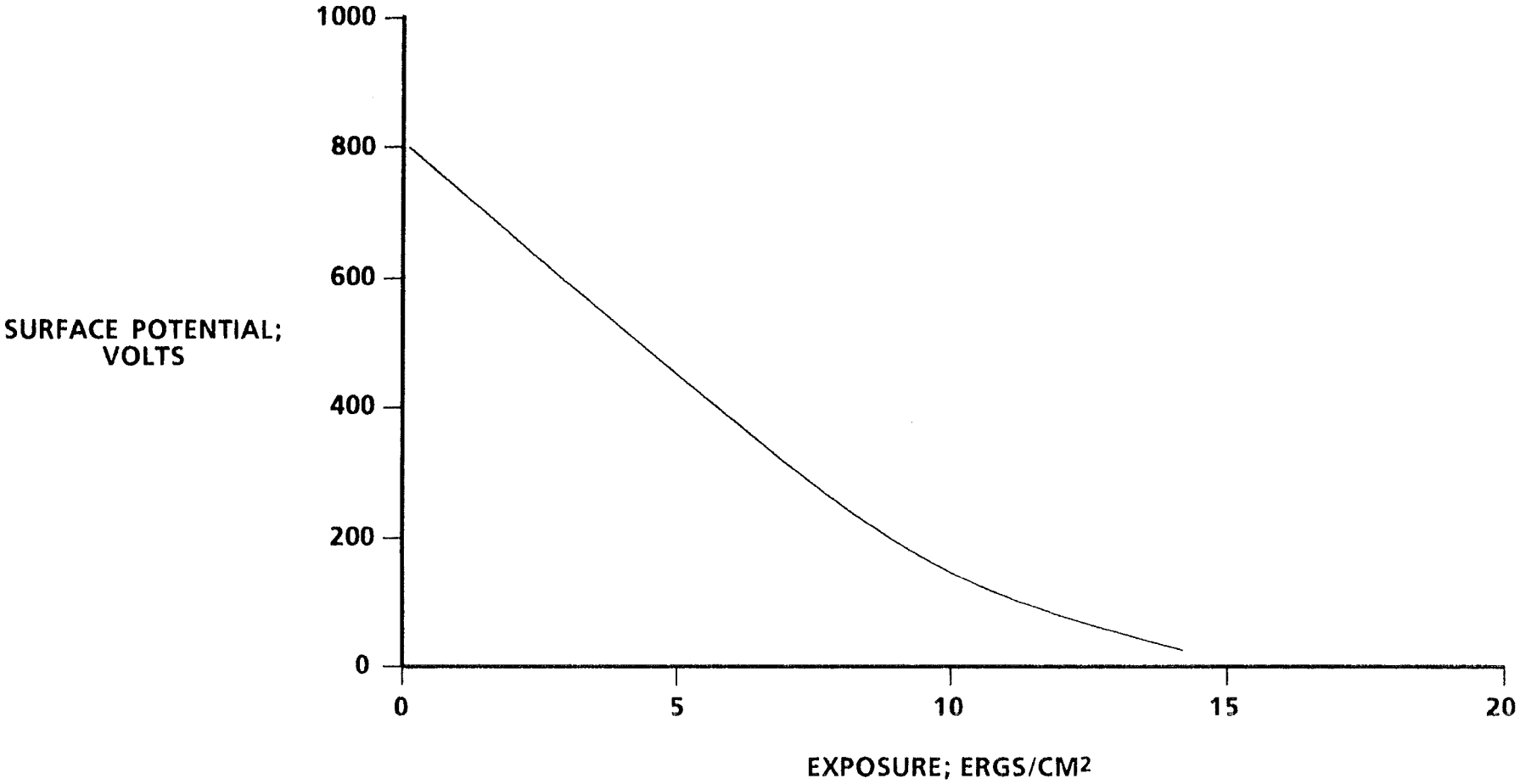
PRIOR ART FIG. 3
FIG. 3 is a photo-induced discharge characteristic curve obtained for the prior art electrophotographic imaging member.

The photo-induced discharged characteristic curve presented in FIG. 3 is obtained for a typical prior art electrophotographic imaging member of FIG. 1A, using an 80 volume percent benzimidazole perylene (PCGP) pigment dispersion 10 in a 20 volume percent E. I. duPont 49,000 polyester binder charge generation layer 6.

Figure 4:
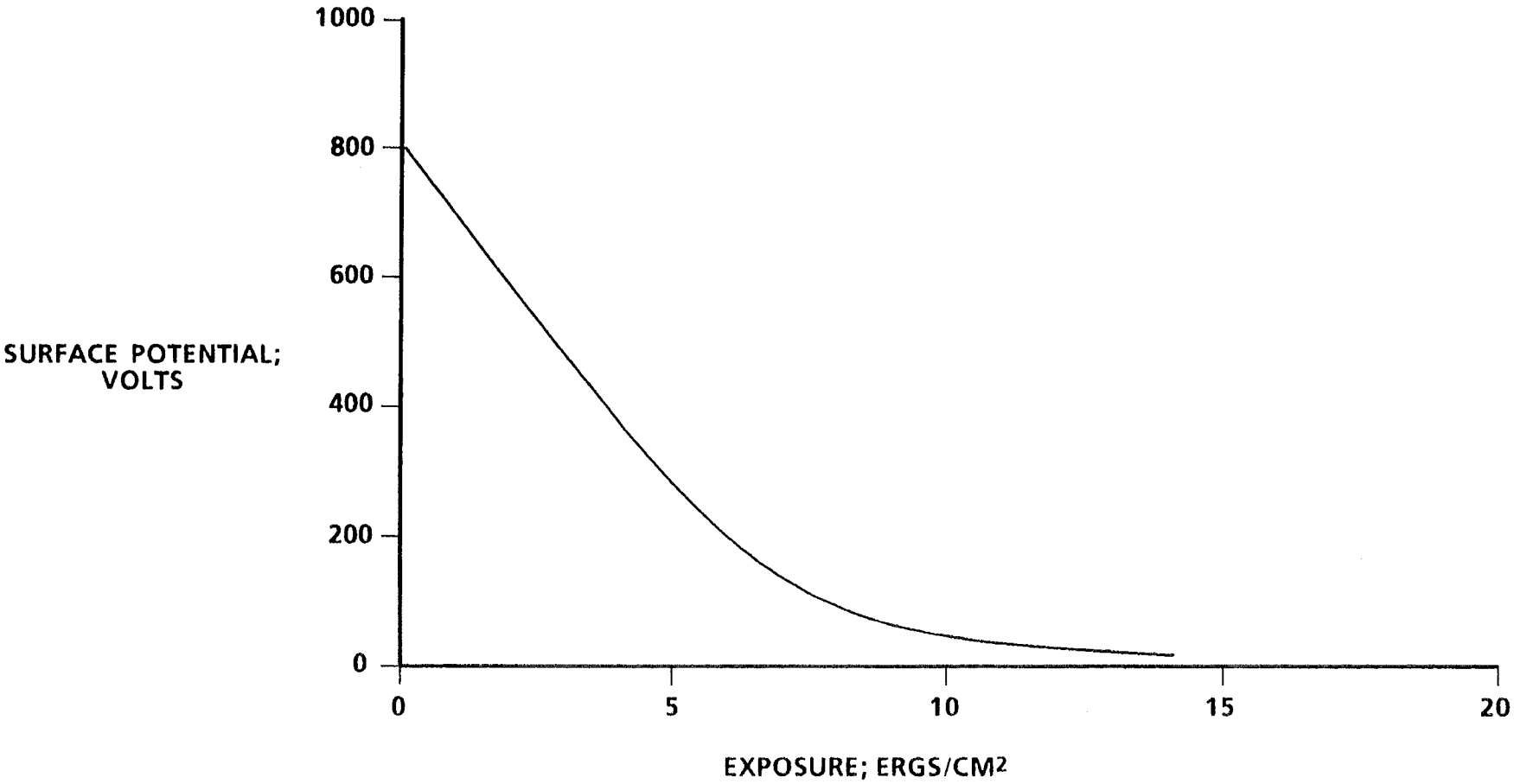
FIG. 4 shows a photo-induced discharge characteristic curve of the embodiment of an electrophotographic imaging member of this invention having a charge generation layer modified to provide enhanced photosensitivity.

As shown in the curve of FIG. 4, the photo-induced discharge characteristic for an electrophotographic imaging member of one embodiment of this invention exhibits a faster surface potential discharge effect upon subjection to light exposure. The structural composition of this imaging member embodiment essentially corresponds to that of the prior art imaging member which gave the photo-induced discharge characteristic curve in FIG. 3, but with the exception that 5 percent by weight of (4-butoxycarbonyl-9-fluorenylidene)malonitrile, electron accepting/transporting compound 11, is incorporated into a film forming binder material matrix and dispersed pigment mixture at a ratio of 80 volume percent PCGP pigment/20 volume percent E. I. duPont 49,000 polyester to form charge generation layer *6i* to achieve the effect the observed photosensitivity improvement shown in FIG. 4. If desired, instead of PCGP pigment, the charge generation layer of the imaging members of this invention may comprise dispersions of any other suitable photoconductive pigment particles. Typical photoconductive pigment particles include, for example, vanadyl phthalocyanine, titanyl phthalocyanine, metal free phthalocyanine, chloro indium phthalocyanine, azo pigments, perylene pigments, selenium, selenium alloys, or the like.

During electrophotographic imaging processes for a negatively charged system, the electron/hole pairs, created at the PCGP pigment 10 surface in the charge generation layer *6i* by photo-energy absorption, travel in opposite direction under the influence of the applied electric field. The holes move straight upwardly to the top of the imaging member to neutralize the negative surface charges and form a latent image over the charge transport layer 7, while the electrons transport downwardly to reach the conductive ground plane. A preferred electron acceptor employed in the material matrix of the charge generating layer of this invention is (4-alkoxycarbony-9-fluorenylidene)malonitrile (EATM), an organic compound with electron accepting/transporting capability. EATM may be represented by the following formula:

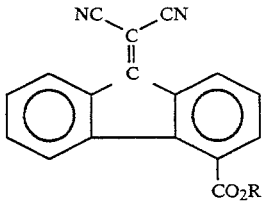

wherein R is an alkyl group having from 1 to 20 carbon atoms or a substituted derivative thereof. When incorporated into the charge generation layer **6*i***, its ability to accept the electrons generated at the particles surface of the excited pigment molecules, after photon absorption during the imaging member charging/exposure processes, is believed to be the key that triggers greatly improved photocarrier generation effects.

The EATM is readily soluble in a wide variety of organic solvents and easily blended into a binder polymer for the charge generation layer such as polyvinylcarbazole, Makrolon, 4,4'cylohexylidene polycarbonate (CHPC), polyester 49,000, polyester Vitel PE-100, polyester Vitel PE-200, and the like. A preferred electron accepting/transporting compound employed in the charge generation layer of this invention may be represented by the following formula:

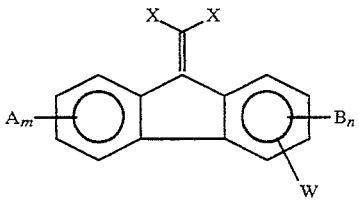

wherein:

X is cyano or alkoxycarbonyl groups,

A and B are electron withdrawing groups, m is a number of from 0 to 2, n is the number 0 to 1, W is an electron withdrawing group selected from the groups consisting of acyl (COR), alkoxycarbonyl (COOR), alkylaminocarbonyl (CONHR), and derivatives thereof and R is selected from an alkyl group having from 1 to 20 carbon atoms or substituted derivatives thereof.

Other examples of electron accepting/transport organic compounds include those represented by the following formulae:

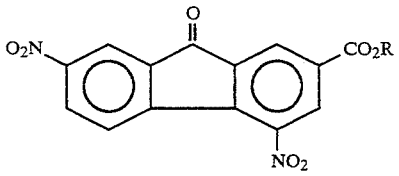

-continued

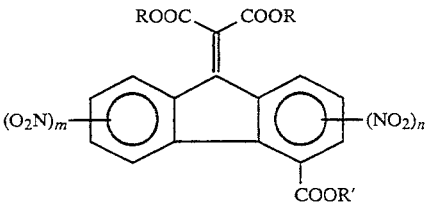

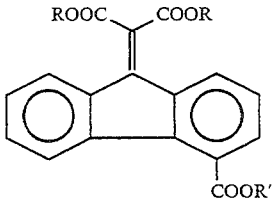

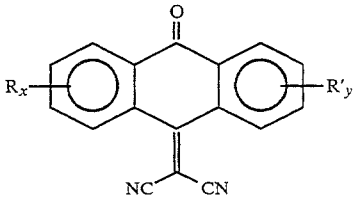

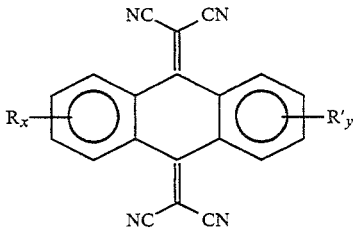

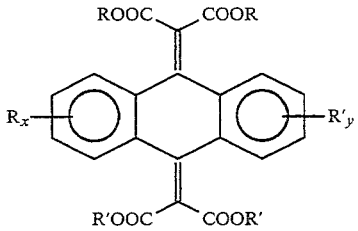

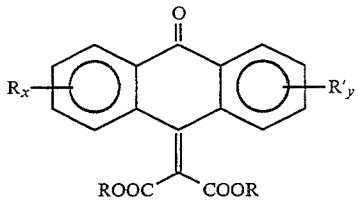

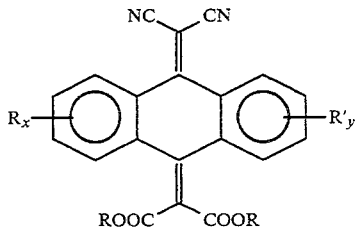

wherein:

R and R' are independently selected from an alkyl group having from 1 to 20 carbon atoms or substituted derivative thereof.

x and y are whole number integers ranging from 0 to 4.

m and n are whole number integers ranging from 0 to 4.

Satisfactory results are achieved when the charge generation layer comprises between about 1 percent and about 20 percent by weight of the electron accepting/transporting compound based on the total dry weight of the charge generation layer. When less than about 1 percent by weight is employed, the improvement in photosensitivity is minimal. When the amount of electron accepting/transporting compound exceeds about 20 percent by weight, photosensitivity improvement appears to level off and no noticeable increase in photosensitivity observed beyond about 20 percent. Moreover, quantities exceeding about 20 percent by weight may adversely affect the mechanical integrity of the charge generating layer. Preferably the charge generating layer contains between about 3 percent and about 10 percent by weight of the electron accepting/-transporting compound based on the total dry weight of the charge generation layer. Optimum results are achieved with between about 5 percent and about 8 percent by weight of the electron accepting/transporting compound.

As indicated above, the photogenerating composition or pigment can be present in the film forming binder or resinous binder composition in various amounts. Generally, from about 5 percent by volume to about 90 percent by volume of the photogenerating pigment 10 is dispersed in about 10 percent by volume to about 95 percent by volume of the film forming binder.

The thin charge generation layer generally has a thickness of between about 0.1 micrometer and about 5 micrometers, and preferably has a thickness of between about 0.3 micrometer and about 3 micrometers. Thicknesses outside these ranges can be selected providing the objectives of the present invention are achieved.

The present invention is directed to photosensitivity improvement of electrophotographic imaging members employing a charge generating layer comprising pigment particles dispersed in a film forming polymer. To achieve this improvement, various electrophotographic imaging member embodiments having been modified to incorporate an electron accepting/transporting compound into the polymer matrix of the charge generating layer are seen to produce excellent results.

The invention will further be illustrated in the following, non-limiting examples, it being understood that these examples are intended to be illustrative only and that the invention in not intended to be limited to the materials, conditions, process parameters and the like recited therein. Parts and percentages are by weight unless otherwise indicated.

COMPARATIVE EXAMPLE I

An electrophotographic imaging member was prepared by providing a web of titanium coated polyester (Melinex, available from ICI Americas Inc.) substrate having a thickness of 3 mils, and applying thereto, with a gravure applicator using a production coater, a solution containing 50 grams 3-amino-propyltriethoxysilane, 50.2 grams distilled water, 15 grams acetic acid, 684.8 grams of 200 proof denatured alcohol and 200 grams heptane. This layer was dried for about 5 minutes at 135° C. in a forced air drier of the coater. The resulting hole blocking layer has a dry thickness of 0.05 micrometer.

An adhesive interface layer was prepared by applying a wet coating over the hole blocking layer, using a gravure applicator. The wet coating contained 5.0 percent by weight based on the total weight of the coating solution of 49,000 polyester adhesive (available from E. I. duPont) in a 70:30 volume ratio mixture of tetrahydrofuran/cyclohexanone. The adhesive interface layer was dried for about 5 minutes at 135° C. in a forced air drier of the coater. The resulting adhesive interface layer had a dry thickness of 0.065 micrometer.

0.76 gram of benzimidazole perylene and 0.14 gram of E. I. du Pont de Nemours 49,000 polyester were mixed in a 60 cc glass bottle containing 100 grams of ⅛ inch stainless steel shot and 19 cc of tetrahydrofuran solvent. The bottle was placed on a roller mill and the mixture milled for 96 hours. Thereafter, the polyester dispersion solution of benzimidazole perylene was coated onto a 9 inch×12 inch sample cut from the coated web described above using a bird applicator having a ½ mil gap, followed by drying in a forced air oven at 135° C. for 5 minutes to form a charge generator layer having a thickness of about 1.0 micrometer and containing 80 volume percent benzimidazole perylene dispersion in 20 volume percent 49,000 polyester binder.

This benzimidazole perylene coated member was removed from the oven and overcoated with a charge transport layer. The charge transport layer coating solution was prepared by introducing into an amber glass bottle in a weight ratio of 1:1, N,N'-diphenyl-N,N'-bis(3-methylphenyl)-1,1'-biphenyl-4,4'-diamine and Makrolon 5705, a polycarbonate resin having a molecular weight of about 100,000 and commercially available from Farbenfabricken Bayer A.G. The resulting mixture was dissolved by adding methylene chloride to the glass bottle to form a 16 weight percent solids charge transport layer solution. This solution was applied onto the photogenerator layer by hand coating using a 3 mil gap Bird applicator to form a wet coating which, upon drying at 135° C. in the forced air oven, for 5 minutes gave a dried charge transport layer thickness of 24 micrometers. During the charge transport layer coating process, the humidity was controlled at or less than 15 percent RH.

At this point, the imaging member was seen to exhibit spontaneous upward curling. An anti-curl coating was then applied to the back of the support substrate to render the imaging member flat. The anti-curl coating solution was prepared in a glass bottle by dissolving 8.82 grams polycarbonate (Makrolon 5705, available from Bayer AG) and 0.09 gram copolyester adhesion promoter (Vitel PE-100, available from Goodyear Tire and Rubber Company) in 90.07 grams methylene chloride. The glass bottle was covered tightly and placed on a roll mill for about 24 hours until total dissolution of the polycarbonate and the copolyester was achieved. The anti-curl coating solution thus obtained was applied to the rear surface of the support substrate (the side opposite to the imaging layers) of the electrophotographic imaging device by hand coating using a 3 mil gap Bird applicator. The coated wet film was dried at 135° C. in a forced air oven for about 5 minutes to produce a dry, 14 micrometers thick anti-curl layer.

EXAMPLE II

An electrophotographic imaging member was prepared by following the same procedures and using the same materials as described in Comparative Example I, with the exception that a one percent by weight (4-butoxycarbony-9-fluorenylident)malonitrile (EATM) was incorporated into the material matrix of the charge generation layer. The EATM was a laboratory synthesized organic compound having inherent electron accepting/transporting characteristic. It was selected for the present invention application to improve the photosensitivity of the imaging member.

EXAMPLE III

An electrophotographic imaging member was prepared in exactly the same manner and using the same materials as described in Example II, except that the amount of EATM in the charge generating layer was five percent by weight.

COMPARATIVE EXAMPLE IV

An electrophotographic imaging member was prepared by following the same procedures and using the same materials as described in Comparative Example I, with the exception that 4,4'-cyclohexylidene polycarbonate (CHPC) was used as the charge generating layer polymer binder to replace the 49,000 polyester and the benzimidazole perylene pigment particles dispersion in the polymer binder was 30 percent by volume. The resulting dried charge generation layer had a thickness of about one micrometer.

EXAMPLE V

An electrophotographic imaging member was prepared by following the same procedures and using the same materials as described in Comparative Example IV, except that five percent by weight EATM was incorporated into the material matrix of the charge generating layer.

EXAMPLE VI

The electrophotographic imaging members prepared according to Examples I through V were cut into 3 inch×4 inch samples and each were evaluated for photo-electrical integrity using a xerographic testing scanner comprising a cylindrical aluminum drum having a diameter of 24.26 cm (9.55 inches). The test samples were taped onto the drum. When rotated, the drum carrying the samples produced a constant surface speed of 76.3 cm (30 inches) per second. A direct current pin corotron, exposure light, erase light, and five electrometer probes were mounted around the periphery of the mounted imaging samples. The sample charging time was 33 milliseconds. Both expose and erase lights had broad band white light (400–700 nm) outputs, each comprising a 300 watt output Xenon arc lamp. The relative locations of the probes and lights are indicated in Table I below:

TABLE I

| Element | Angle (Degrees) | Position | Distance From Photoreceptor |
|---|---|---|---|
| Charge | 0 | 0 | 8 mm (Pins)<br>12 mm (Shield) |
| Probe 1 | 22.50 | 47.9 mm | 3.17 mm |
| Expose | 56.25 | 118.8 | N.A. |
| Probe 2 | 78.75 | 166.8 | 3.17 nm |
| Probe 3 | 168.75 | 356.0 | 3.17 mm |
| Probe 4 | 236.25 | 489.0 | 3.17 mm |
| Erase | 258.75 | 548.0 | 125.00 mm |
| Probe 5 | 303.75 | 642.9 | 3.17 mm |

The test samples were first rested in the dark for at least 60 minutes to ensure achievement of equilibrium with the testing conditions at 5 percent relative humidity and 21° C. Each sample was then negatively charged in the dark to a development potential of about 900 volts. The charge acceptance of each sample and its residual potential after discharge by front erase light exposure at 400 ergs/cm$^2$ were recorded. The test procedure was repeated to determine the photo induced discharge characteristic (PIDC) of each sample by different light energies of up to 20 ergs/cm$^2$. The 50,000 cycles electrical testing results obtained for the test samples of Examples I through V are collectively tabulated in the following Table II.

TABLE II

| Example | Polymer Binder | EATM % | Residual Potential (Y) | 50K Cycles Cycle Down (%) | Photosensitivity 800V–100V (Ergs/cm2) |
|---|---|---|---|---|---|
| I (control) | 49,000 | 0 | 5 | 3.5 | 10.6 |
| II | 49,000 | 1 | 6 | 4.2 | 9.5 |
| III | 49,000 | 5 | 5 | 3.6 | 7.5 |
| IV (control) | CHPC | 0 | 7 | 4.7 | 16.0 |
| V | CHPC | 5 | 6 | 3.9 | 13.2 |

The 50,000 cycles electrical data show that incorporation of electron accepting/transporting compound EATM into the material matrix of the benzimidazole perylene dispersion charge generation layer gave significant photosensitivity improvement by up to about 30 percent. The photo-induced discharge characteristics for the control imaging member of Comparative Example I and the imaging member of this invention having 5 percent by weight electron accepting/transporting compound in the charge generating layer of Example III, are shown in the potential/exposure energy curves in FIGS. 1 and 2, respectively. The effect of photosensitivity improvement decreased as the content of EATM in the charge generating layer was decreased. When the same polymer binder was used, the efficiency of photosensitivity improvement was seen to increase according to the loading level of benzimidazole perylene dispersion in the charge generation layer. It was interesting to note that the type of polymer binder chosen for charge generating layer application could also have a direct impact on the effectiveness of EATM functions. For example, the 49,000 polyester binder was observed to provide better results than the CHPC counterpart. It is also important to point out that except for the photosensitivity improvement, EATM presence in the charge generating layer did not alter the overall electrical properties of the original electrophotographic imaging member controls.

EXAMPLE VII

The electrophotographic imaging members of Examples I through V were evaluated for adhesion properties using a 180° peel test method.

The 180° peel strength was determined by cutting a minimum of five 0.5 inch×6 inch imaging member samples from each of Examples I and V. For each sample, the charge transport layer was partially stripped from the test imaging member sample with the aid of a razor blade and then hand peeled to about 3.5 inches from one end to expose part of the underlying charge generating layer. The test imaging member sample was secured with its charge transport layer surface toward a 1 inch×6 inches×0.25 inch aluminum backing plate with the grid of two sided adhesive tape. Under these conditions, the anti-curl layer/substrate of the stripped segment of the test sample could easily be peeled away 180° from the sample to cause the adhesive layer to separate from the charge generating layer. The end of the resulting assembly opposite to the end from which the charge transport layer was not stripped was inserted into the upper jaw of an Instron Tensile Tester. The free end of the partially peeled anticurl/substrate strip was inserted into the low jaw of the Instron Tensile Tester. The jaws were then activated at a 1 inch/mn crosshead speed, a 2 inch chart speed and a load range of 200 grams to 180° peel the sample at 2 inches. The load monitored with a chart recorder was calculated to give the peel strength by dividing the average load required for stripping the anti-curl layer with the substrate by the width of the test sample. The results obtained, given in Table Ill below, indicates that incorporation of EATM into the material matrix of the charge generation layer produced no deleterious affect on the adhesion bond strength in the imaging members.

TABLE III

| Example | Polymer Binder | EATM % | 180° Peel Strength (gms/cm) |
|---|---|---|---|
| I (control) | 49,000 | 0 | 8.7 |
| II | 49,000 | 1 | 9.4 |
| III | 49,000 | 5 | 9.8 |
| IV (control) | CHPC | 0 | 7.5 |
| V | CHPC | 5 | 8.3 |

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising a substrate, an optional blocking layer, an optional thermoplastic adhesive interface layer, a thin charge generation layer comprising pigment particles dispersed in a film forming polymer binder having dissolved or molecularly dispersed therein an electron accepting/transporting compound, and a charge transport layer, wherein said charge generation layer comprises between about 1 percent and about 20 percent by weight of said electron accepting/transporting compound based on the total weight of said charge generation layer and said electron accepting/transporting compound comprises a compound having a formula selected from the group consisting of:

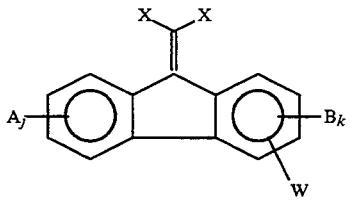

-continued

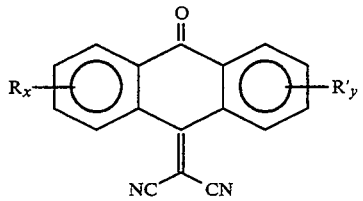

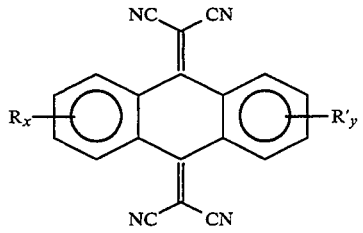

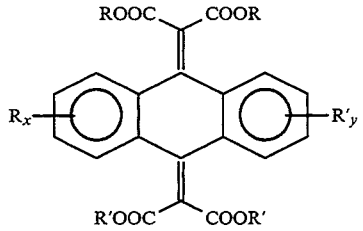

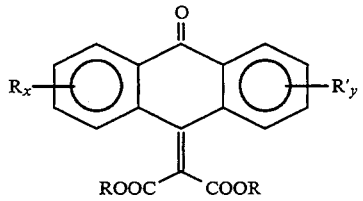

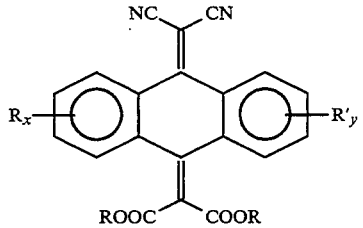

wherein

X is an alkoxycarbonyl group,

A and B are electron withdrawing groups, j is a whole number integer ranging from 0 to 2, k is a whole number integer ranging from 0 to 1, m and n are whole number integers ranging from 0 to 4 x and y are whole number integers ranging from 0 to 4,

W is an electron withdrawing group selected from the group consisting of acyl (COR), alkoxycarbonyl (COOR), alkylaminocarbonyl (CONHR), and derivatives thereof, and R and R' are selected from the group consisting of an alkyl group having from 1 to 20 carbon atoms and substituted derivative thereof.

2. An electrophotographic imaging member according to claim 1 wherein said pigment particles comprise a perylene.

3. An electrophotographic imaging member according to claim 2 wherein said pigment particles comprise benzimidazole perylene.

4. An electrophotographic imaging member according to claim 1 wherein said charge generation layer comprises between about 3 percent and about 10 percent by weight of said electron accepting/transporting compound based on the total weight of said charge generation layer.

5. An electrophotographic imaging member according to claim 4 wherein said charge generation layer comprises between about 5 percent and about 8 percent by weight of said electron accepting/transporting compound based on the total weight of said charge generation layer.

6. An electrophotographic imaging member according to claim 1 wherein said charge generation layer has a dry thickness of between about 0.1 micrometer and about 5 micrometers.

7. An electrophotographic imaging member according to claim 1 wherein said substrate comprises a flexible web.

8. An electrophotographic imaging member according to claim 1 wherein said substrate comprises a rigid drum.

9. An electrophotographic imaging member according to claim 1 wherein said pigment particles comprise a phthalocyanine.

10. An electrophotographic imaging member according to claim 1 wherein said electron accepting/transporting compound has a formula selected from the group consisting of:

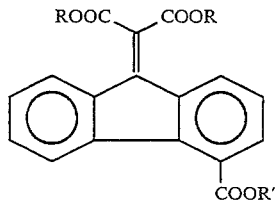

and

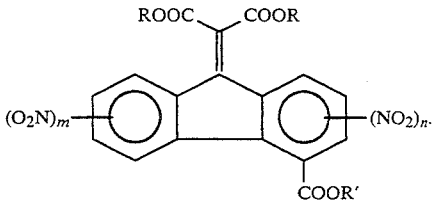

* * * * *